US011812850B2

(12) United States Patent
Huggan

(10) Patent No.: US 11,812,850 B2
(45) Date of Patent: Nov. 14, 2023

(54) LATCHING MECHANISM

(71) Applicant: HUGGAN CO PTY LTD, South Croydon (AU)

(72) Inventor: Brett Huggan, South Croydon (AU)

( * ) Notice: Subject to any disclaimer, the term of this patent is extended or adjusted under 35 U.S.C. 154(b) by 204 days.

(21) Appl. No.: 17/296,147

(22) PCT Filed: Nov. 20, 2019

(86) PCT No.: PCT/AU2019/051278
§ 371 (c)(1),
(2) Date: May 21, 2021

(87) PCT Pub. No.: WO2020/102853
PCT Pub. Date: May 28, 2020

(65) Prior Publication Data

US 2022/0015538 A1 Jan. 20, 2022

(30) Foreign Application Priority Data

Nov. 22, 2018 (AU) ..... 2018904465

(51) Int. Cl.
*A47B 88/50* (2017.01)
*A47B 95/02* (2006.01)
(Continued)

(52) U.S. Cl.
CPC ..... *A47B 88/50* (2017.01); *A47B 95/02* (2013.01); *E05B 65/06* (2013.01); *E05B 65/46* (2013.01);
(Continued)

(58) Field of Classification Search
CPC . E05B 65/46; E05B 65/06; A47B 2210/0016; A47B 2210/0018;
(Continued)

(56) References Cited

U.S. PATENT DOCUMENTS 93,112 A * 7/1869 Moser ..... E05C 1/14 292/170
1,854,646 A * 4/1932 Doucette ..... E05D 13/06 292/174
(Continued)

FOREIGN PATENT DOCUMENTS

DE 19736792 A1 1/1999
DE 20 2015 004415 U1 9/2016
(Continued)

OTHER PUBLICATIONS

ISR: Australian Patent Office; dated Jan. 8, 2020.
(Continued)

*Primary Examiner* — Andrew M Roersma
(74) *Attorney, Agent, or Firm* — Patshegen IP; Moshe Pinchas

(57) ABSTRACT

A latching mechanism (1) for a drawer or door has handle (2) which is pulled towards a user when the latching mechanism is being opened and pushed away from the user when the latching mechanism is being closed. A latch (3) is moveable between an extended orientation and a retracted orientation; an oblique surface (4) on the latch (3) contacts an actuator (5) when handle (2) is pulled towards the user, forcing the latch (3) towards the retracted orientation; biasing means biases latch (3) towards the extended orientation; and link (7) connects handle (2) to the other parts of the latching mechanism. When installed, link (7) is installed over an edge of a drawer or door so that the handle is located on the front side of the door or drawer and the latch, actuator and biasing means are located on the rear side of the door or drawer.

6 Claims, 4 Drawing Sheets

(51) Int. Cl.

| | |
|---|---|
| ***E05B 65/46*** | (2017.01) |
| ***E05B 65/06*** | (2006.01) |
| ***E05C 1/00*** | (2006.01) |
| ***E05C 19/00*** | (2006.01) |

(52) U.S. Cl.
CPC ..... *E05C 1/00* (2013.01); *E05C 19/00* (2013.01); *A47B 2095/024* (2013.01)

(58) Field of Classification Search
CPC .... A47B 2210/0086; A47B 2210/0089; A47B 88/50; A47B 88/53; A47B 88/57; A47B 88/16; A47B 88/473; A47B 88/477; A47B 2095/024; A47B 95/02; Y10S 292/31; Y10T 292/0969; Y10T 292/0976; Y10T 292/0977; Y10T 292/0995; E05C 1/00; E05C 19/00
See application file for complete search history.

(56) References Cited

U.S. PATENT DOCUMENTS

| | | | | | |
|---|---|---|---|---|---|
| 2,158,983 | A * | 5/1939 | Knoll | E05C 1/14 | 292/DIG. 57 |
| 2,648,561 | A * | 8/1953 | Landon | E05C 1/14 | 292/170 |
| 3,830,535 | A * | 8/1974 | Read | E05C 1/14 | 292/336.3 |
| 3,918,752 | A * | 11/1975 | Leone | E05B 65/0014 | 292/277 |
| 6,412,317 | B1 * | 7/2002 | Martin | E05B 9/08 | 70/451 |
| 6,550,824 | B1 * | 4/2003 | Ramsauer | E05B 65/0852 | 292/52 |
| 8,757,675 | B2 * | 6/2014 | Loret de Mola | E05C 9/046 | 292/170 |
| 2015/0197969 | A1 | 7/2015 | Tung | | |
| 2018/0245383 | A1 * | 8/2018 | Jeffries | E05C 3/008 | |
| 2018/0320422 | A1 | 11/2018 | Sharp | | |
| 2019/0106907 | A1 * | 4/2019 | Pavlik | E05B 61/00 | |

FOREIGN PATENT DOCUMENTS

| | | | | | |
|---|---|---|---|---|---|
| EP | 2489817 | A2 | | 8/2012 | |
| GB | 2539950 | A | * | 1/2017 | E05B 65/0014 |
| JP | S59 82166 | U | | 6/1984 | |
| JP | S5982166 | U | | 6/1984 | |
| JP | H08 303088 | A | | 11/1996 | |
| JP | H09 13773 | A | | 1/1997 | |
| JP | H0913773 | A | | 1/1997 | |
| JP | 3354772 | B2 | | 12/2002 | |
| JP | 2016 017302 | A | | 2/2016 | |
| JP | 2016017302 | A | | 2/2016 | |
| KR | 1020110028704 | A | * | 3/2011 | E05B 65/44 |
| KR | 101370792 | B1 | * | 2/2014 | E05B 65/44 |

OTHER PUBLICATIONS

Australian Patent Office International-Type Search Report; dated Sep. 12, 2019.
European Search Report; European Patent Office; dated Jun. 28, 2022.

* cited by examiner

LATCHING MECHANISM

TECHNICAL FIELD

This invention relates to a latching mechanism. It relates particularly but not exclusively to a mechanism for opening and closing drawers and cupboard doors, suitable for use where the drawers and cupboard doors are prone to vibrations, such as in a caravan, mobile home, aircraft or boat, or in earthquake-prone areas.

BACKGROUND ART

Drawers and cupboard doors are frequently held in a closed position by gravity, friction or magnets. This is fine in situations where the natural forces of gravity, friction or magnetism are sufficient to hold the drawers or doors closed, but it is less satisfactory in environments where the doors on drawers are prone to falling open; for example, in situations where movement or vibration exerts forces which may result in the doors or drawers opening inconveniently, and perhaps spilling their contents.

One common method for keeping doors closed until someone deliberately wishes to open them is to provide a latch operated by a rotating handle. When the handle is rotated, the latch is retracted from a striker plate, enabling the door to be opened. Similarly, in the case of drawers, one common mechanism for keeping them shut involves a latch operated by a rotating key. When the key is rotated, the drawers are unlocked, enabling easy opening.

However, it is often inconvenient to require a rotating handle for each door and a key for each drawer, and in many cases the protrusions created by rotating handles and keys are inconvenient or unsightly. In many cases the addition of rotating handles or keys to doors or drawers adds undesirable costs.

Caravans and mobile homes typically have a number of drawers and cupboards which need to be latched shut to prevent inadvertent opening whenever the caravan or mobile home turns around a corner or goes over a bump. The mechanism commonly provided for drawers and doors in caravans and mobile homes is a latch connected to a button located on a small handle. To open the drawer or cupboard, an operator presses the button, which causes the latch to be retracted, allowing the operator to pull the handle and open the door or drawer. However, this requires the operator to press the button towards the drawer or door while at the same time pulling the handle in a direction away from the drawer or door, an operation which requires two hands or at least a degree of manual dexterity. Moreover, the installation of such latching mechanisms is often complex, frequently requiring the installation of multiple parts or the accurate drilling of several holes.

Another drawer latch mechanism is sometimes found in car glove boxes. The glove box includes a handle set into a recess in the outer surface of the glove box. An operator who wishes to open the glove box lifts the handle, which causes a latch to be retracted, allowing the glove box to rotate down to an open position. However, these latch mechanisms are designed as part of the glove boxes, rather than being something which can be added to a pre-existing drawer, and substantial efforts are typically required to install or replace such a mechanism.

Although drawer and door latches which operate when users pull the handle towards them, rather than pushing a button or rotating a knob or performing some other function, are fairly rare, an example of such a latch is disclosed in Japanese Patent Application JPH0913773A. That document describes a knob which communicates via a threaded bolt through a hole in a drawer or cupboard door with a latch which is normally biased into a closed orientation but withdraws into an open orientation when the handle is pulled, enabling the drawer or door to open. However, the installation of this latching mechanism is fairly complex, requiring a hole to be drilled through the door or drawer and then for parts to be assembled on both sides of the door or drawer.

DISCLOSURE OF THE INVENTION

According to a first aspect of the present invention, there is provided a latching mechanism for a drawer which has a front panel with a front side and a rear side, the latching mechanism including:

a) A handle which is pulled towards a user when the latching mechanism is being opened and pushed away from the user when the latching mechanism is being closed;
b) A latch which is moveable between an extended orientation and a retracted orientation;
c) An oblique surface on the latch which is obliquely angled relative to the direction of opening or closing movement of the handle;
d) An actuator which contacts the oblique latch surface when the handle is pulled towards the user, forcing the latch towards the retracted orientation;
e) Biasing means which biases the latch towards the extended orientation; and
f) A link which connects the handle to the other parts of the latching mechanism;

wherein, when the latching mechanism is installed on a drawer, the link is installed over an edge of the drawer front panel so that the handle is located on the front side of the front panel and the latch, actuator and biasing means are located on the rear side of the front panel.

According to a second aspect of the present invention, there is provided a latching mechanism for a door which has a front side and a rear side, the latching mechanism including:

a) A handle which is pulled towards a user when the latching mechanism is being opened and pushed away from the user when the latching mechanism is being closed;
b) A latch which is moveable between an extended orientation and a retracted orientation;
c) An oblique surface on the latch which is obliquely angled relative to the direction of opening or closing movement of the handle;
d) An actuator which contacts the oblique latch surface when the handle is pulled towards the user, forcing the latch towards the retracted orientation;
e) Biasing means which biases the latch towards the extended orientation; and
f) A link which connects the handle to the other parts of the latching mechanism;

wherein, when the latching mechanism is installed on a door, the link is installed over an edge of the door so that the handle is located on the front side of the door and the latch, actuator and biasing means are located on the rear side of the door.

The latching mechanism is preferably configured so that installation of the latching mechanism on a drawer or door occurs without making any modifications to the drawer or door other than attachment of the latching mechanism.

Preferably the latching mechanism is configured to attach only to the rear side of a drawer front panel or to the rear side of a door.

In a preferred embodiment, the handle, link and actuator are integrally formed from a single sheet of metal or plastic. This embodiment may include the following additional features:

g) The sheet of metal or plastic is substantially in the shape of a rectangle, having a front end and a rear end;
h) The handle is formed by bending the front end of the rectangle relative to the plane of the rectangle; and
i) The rectangle includes an internal aperture, one edge of which functions as the actuator.

In this context, "substantially in the shape of a rectangle" includes a rectangular shape with rounded corners.

Additional preferred features include:

j) The rear end of the rectangle is also bent relative to the plane of the rectangle; and
k) The rear end of the rectangle attaches slidably to a chamber which substantially houses the latch and the biasing means.

The latching mechanism may further include a second actuator which has an oblique surface oriented at an angle matching that of an internal oblique surface on the latch, so that the oblique surface of the second actuator slides across the latch internal oblique surface as the handle is pulled towards the user, forcing the latch towards the retracted orientation, and when the handle is no longer being pulled, the biasing means urges the latch towards the extended orientation, causing the oblique surface of the second actuator to slide back across the latch internal oblique surface and restoring the actuator to its original orientation.

The latching mechanism may co-operate with any suitable striker to retain the latching mechanism in a closed orientation. The striker may be provided by a pre-existing edge or plate located on a surface in a cabinet or cupboard or on a surface immediately above a drawer, or it may be provided by the installation of a device such as a metal or plastic plate which provides a suitable edge.

In one arrangement, the latching mechanism may further include a striker plate which co-operates with the latch to retain the latching mechanism in a closed orientation until the handle is pulled towards the user.

An especially preferred type of striker plate is substantially in the shape of a circle with a flattened side, with the flattened side forming the striker which co-operates with the latch. The mostly-circular shape of the striker plate facilitates easy installation, as the installer can drill a shallow circular recess in the surface on which the striker plate is to be mounted, and the striker plate can then be installed into the circular recess.

The invention will now be described in greater detail by reference to preferred embodiments. However, that the specificity of various features described in the drawings does not supersede the generality of the preceding principles, and it is to be understood that the scope of the invention is not limited by the particular appearance and configuration of features illustrated in the drawings.

BEST MODES FOR CARRYING OUT THE INVENTION

Figure 1:
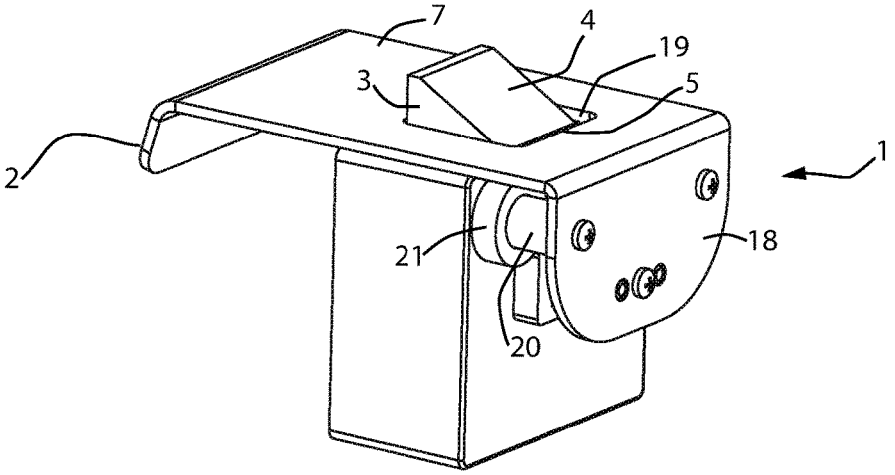
FIG. 1 shows a perspective view of a latching mechanism according to one embodiment of the present invention.

The specific embodiment of the invention shown in the drawings consists of a latching mechanism 1. The latching mechanism includes a handle 2 which is pulled towards a user (in a direction towards the left of the page) when latching mechanism 1 is being opened and pushed away from the user when latching mechanism 1 is being closed.

Figure 4:
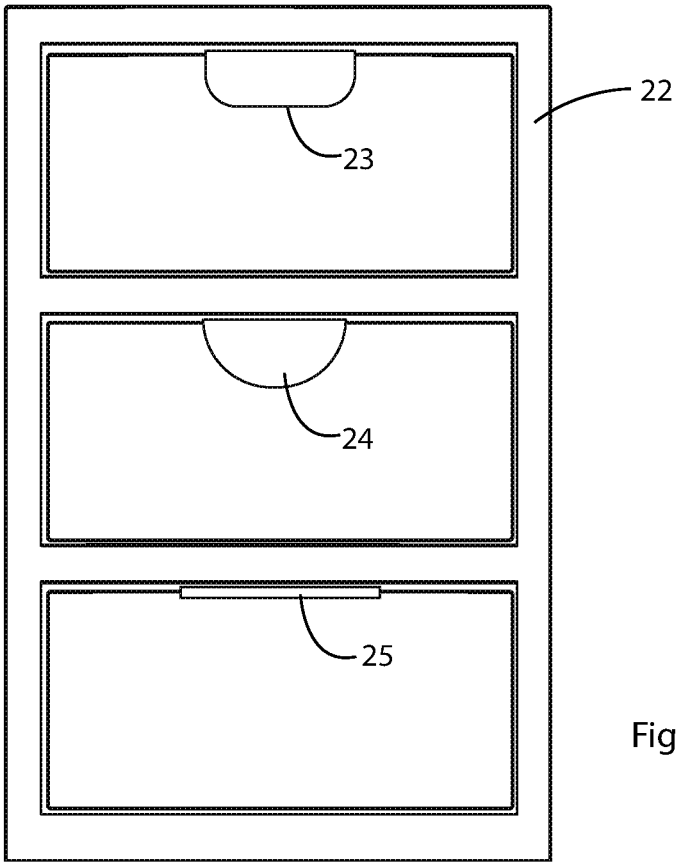
FIG. 4 shows a front view of a drawer cabinet featuring different types of handles for latching mechanisms according to embodiments of the invention.

Latching mechanism 1 further includes a latch 3 which is moveable between an extended orientation (as shown in FIGS. 1 and 4) and a retracted orientation.

An oblique surface 4 on latch 3 is obliquely angled relative to the direction of opening or closing movement of the handle, and an actuator 5 contacts oblique latch surface 4 when handle 2 is pulled towards the user, forcing latch 3 towards the retracted orientation, which is in a downwards direction in the Figures.

Figure 9:
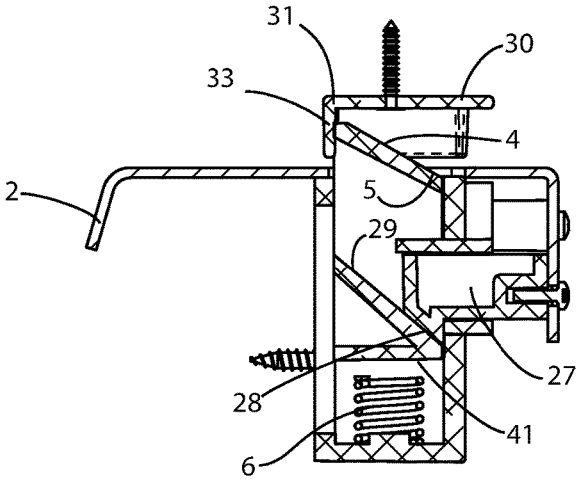
FIG. 9 shows a cross-sectional view of the latching mechanism of FIG. 3, taken along the line E-E.

Latching mechanism 1 further includes biasing means 6 (shown in FIG. 9) which biases latch 3 towards the extended orientation. Biasing means 6 may be a coil spring, leaf spring, piece of flexible resilient rubber or plastic, or any other suitable material which provides a similar effect.

Latching mechanism 1 further includes link 7 which connects handle 2 to the other parts of latching mechanism 1. When latching mechanism 1 is installed on a drawer (as shown in FIGS. 2 and 3), link 7 is installed over an edge 8 of drawer front panel 9 so that handle 1 is located on front side 10 of front panel 9 and latch 3, actuator 5 and biasing means 6 are located on rear side 11 of front panel 9.

Figure 2:
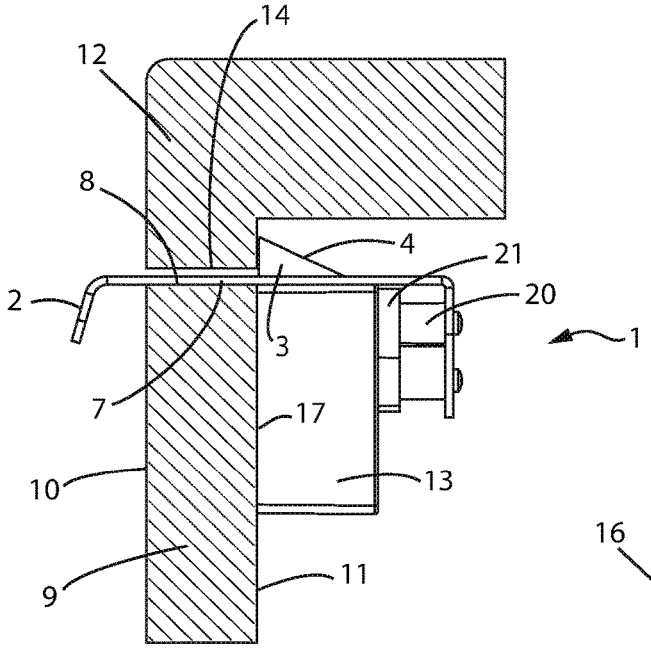
FIG. 2 shows a side view of the latching mechanism of FIG. 1, installed on a drawer in a drawer cabinet.

In the arrangement illustrated in FIG. 2, latch 3 normally locates behind cabinet face 12 to retain drawer front panel 9 in its closed position as shown. When handle 2 is pulled towards the user away from drawer front panel 9, actuator 5 operates on oblique latch surface 4, causing latch 3 to be withdrawn into chamber 13 against the force of biasing means 6, enabling the drawer to be opened. When the drawer is being closed again, oblique surface 4 of latch 3 contacts the underside 14 of cabinet face 12, causing latch 3 to retract again until the drawer is fully closed, at which stage latch 3 springs back to its normal position as shown.

Figure 3:
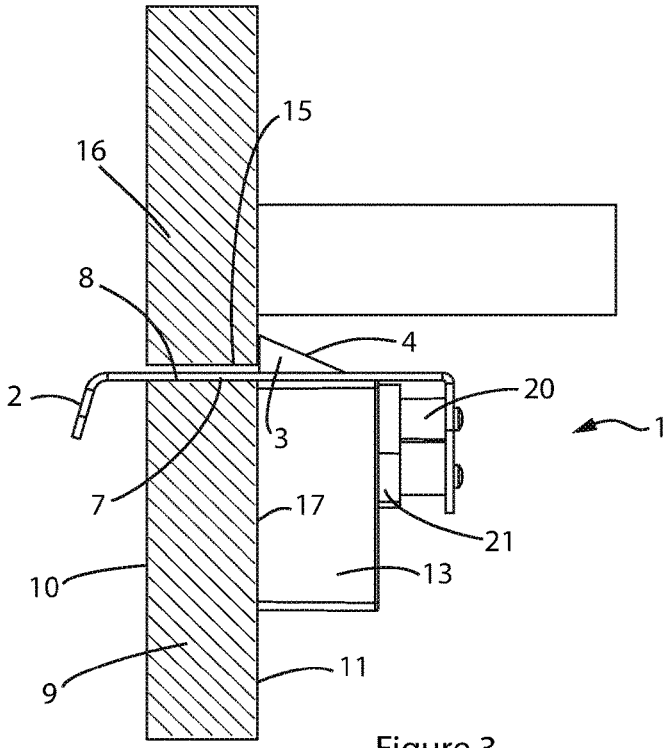
FIG. 3 shows a side view of the latching mechanism of FIG. 1, installed on a drawer underneath another drawer.

In the arrangement illustrated in FIG. 3, latch 3 normally locates behind bottom edge 15 of drawer front panel 16 on a drawer located immediately above drawer front panel 9. Latch 3 otherwise functions is the same manner as illustrated in FIG. 2. If all drawers in a group of drawers located in a vertical stack have similar latching mechanisms, all drawers can by this means be retained in a closed position. When one drawer is opened in such an arrangement, the latching mechanism on the drawer below ceases to function, so this arrangement may not be suitable in some circumstances. However, this arrangement is quite satisfactory in circumstances where a user is only likely to open a drawer when the drawers are not being shaken by external forces.

Although in the arrangements illustrated in FIGS. 2 and 3 the latching mechanisms are installed over the top edge of drawer front panels, they may alternatively be installed over a side or bottom edge of a drawer front panel if there is room.

It will be appreciated that a particular advantage of latching mechanism 1 over the prior art is that it can be fitted to many types of drawer front panels and doors without any modifications being made to the drawers or doors. All that is required for installation is to fix chamber front face 17 to rear side 11 of drawer front panel 9. This can be done by means of glue, double-sided adhesive, or any other suitable type of adhesive substance. Alternatively, it may be done by means of staples, screws, nails or any other suitable type of mechanical fixing.

If there is insufficient space to fit the link of a latching mechanism over an edge of a drawer front panel or door, a notch or groove may be created to accommodate the thickness of the link. This arrangement is still highly advantageous when compared with the prior art because it allows the rapid fitment of a pre-assembled unit, rather than requiring the drilling of a hole followed by assembly of components on both sides of the drawer front panel or door.

In the latching mechanism illustrated in FIGS. 1 to 3, handle 2, link 7 and actuator 5 are all formed from a single sheet of metal or plastic. The sheet of metal or plastic is substantially in the shape of a rectangle with rounded corners, having a front end which forms handle 2 and a rear end 18. Handle 2 is formed by bending the front end of the rectangle downwards relative to the plane of the rectangle in the embodiment shown, but it could equally be formed by bending the front end upwards. The rectangle includes an aperture 19, one edge of which functions as the actuator 5.

In the latching mechanism illustrated in FIGS. 1 to 3, the rear end 18 of the rectangle is also bent downward relative to the plane of the rectangle. This enables it to attach slidably to chamber 13 by means of guide elements 20 which slide within sleeves 21. Chamber 13 substantially houses latch 3 and biasing means 6 as best shown in the cross-sectional view provided by FIG. 9. Guide elements 20 help to guide and constrain the movement of handle 2 relative to the rest of latching mechanism 1.

FIG. 4 shows a cabinet 22 with three drawers each having latching mechanisms according to embodiments of the invention. The handle 23 on the top drawer is similar to those shown in FIGS. 1 to 3. The handles 24 and 25 on the other drawers have different shapes. It will be appreciated that the handles may have any suitable shape.

Figure 5:
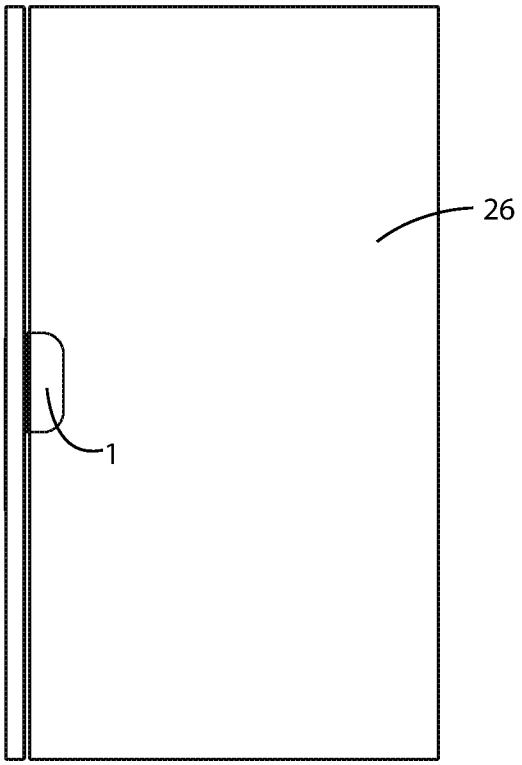
FIG. 5 shows a front view of a cupboard incorporating a latching mechanism according to an embodiment of the present invention.
Figure 6:
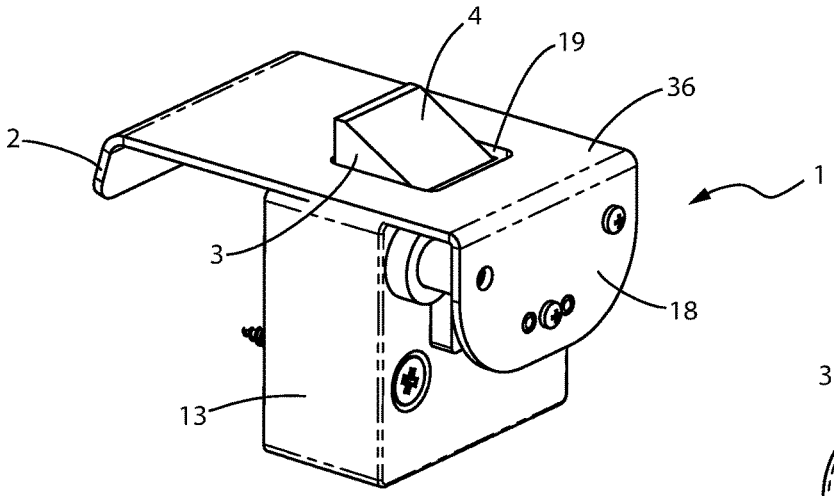
FIG. 6 shows a perspective view of a latching mechanism according to another embodiment of the present invention.

In the arrangement shown in FIG. 5, latching mechanism 1 has been applied to a door 26, rather than to a drawer front panel as shown in FIGS. 1 to 3. The door latching mechanism otherwise works in the same manner as the drawer latching mechanism of FIGS. 1 to 3. Although the latching mechanism will normally be applied to the side edge of the door opposite the edge to which the door's hinges are attached, it may alternatively be applied to the top or bottom edge of the door.

Referring now to the embodiment illustrated in FIGS. 6 to 10, this embodiment further includes a second actuator 27 (best seen in FIGS. 9 and 10) which has an oblique surface 28 oriented at an angle matching that of an internal oblique surface 29 on latch 3, so that oblique surface 28 of second actuator 27 slides across latch internal oblique surface 29 as handle 2 is pulled towards the user, forcing latch 3 towards the retracted orientation, and when handle 2 is no longer being pulled, biasing means 6 urges latch 3 towards the extended orientation, causing oblique surface 28 of second actuator 27 to slide back across latch internal oblique surface 29 and restoring latch 3 to its original orientation. Although the same effect could be achieved with a single actuator, this arrangement adds a greater degree of stability to the mechanism. It will be appreciated that in other embodiments the latch mechanism can include more than two oblique latch surfaces and more than two actuators.

The latching mechanism may co-operate with any suitable striker to retain the latching mechanism in a closed orientation. The striker may be provided by a pre-existing edge or plate located on a surface in a cabinet or cupboard or on a surface immediately above a drawer, or it may be provided by the installation of a device such as a metal or plastic plate which provides a suitable edge.

The arrangement shown in FIGS. 7 to 10 includes a striker plate 30 which co-operates with latch 3 to retain the latching mechanism 1 in a closed orientation until the handle is pulled towards the user. A striker plate is useful in circumstances where there is no convenient edge or ledge (of the types shown in FIGS. 1 to 3) behind which the latch can locate to keep the door or drawers closed.

Figure 7:
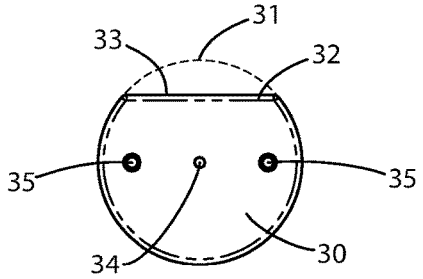
FIG. 7 shows a top view of a striker plate suitable for use in conjunction with the latching mechanism of FIG. 6.
Figure 8:
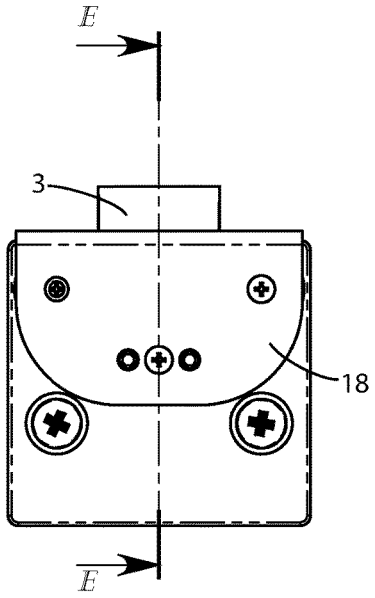
FIG. 8 shows an end view of the latching mechanism of FIG. 6.

The striker plate 30 shown in FIG. 7 is substantially in the shape of a circle 31 with a flattened side 32. A straight edge 33 protruding from flattened side 32 forms the striker which, as best shown in FIG. 8, co-operates with latch 3. The mostly-circular shape of the striker plate facilitates easy installation, as the installer can drill a shallow circular recess in the surface on which the striker plate is to be mounted, the circular recess having a radius matching that of the striker plate, and the striker plate can then be installed into the circular recess.

The striker plate 30 as shown in FIG. 7 includes the optional feature of a hole 34 in the radial centre. When the latching mechanism is being installed, striker plate 30 can be moved until a suitable location is found, and a mark can then be made through hole 34 to indicate the location for the centre of a drill which can be used to create the optional circular recess.

The striker plate 30 as shown in FIG. 7 further includes screw holes 35 through which screws can be inserted to fix the plate in position.

The individual components of this example embodiment will now be described with reference to the exploded perspective view illustrated in FIG. 10. At the top, striker plate 30 is shown from a perspective view. The straight edge, which protrudes downwardly from flattened side 32 and forms the striker, is on the underside of striker plate 30 and not visible from this perspective. Striker plate 30 includes radially central hole 34 and screw holes 35 as previously described. Striker plate 30 may be made from metal, plastic or any other suitable substance.

Figure 10:
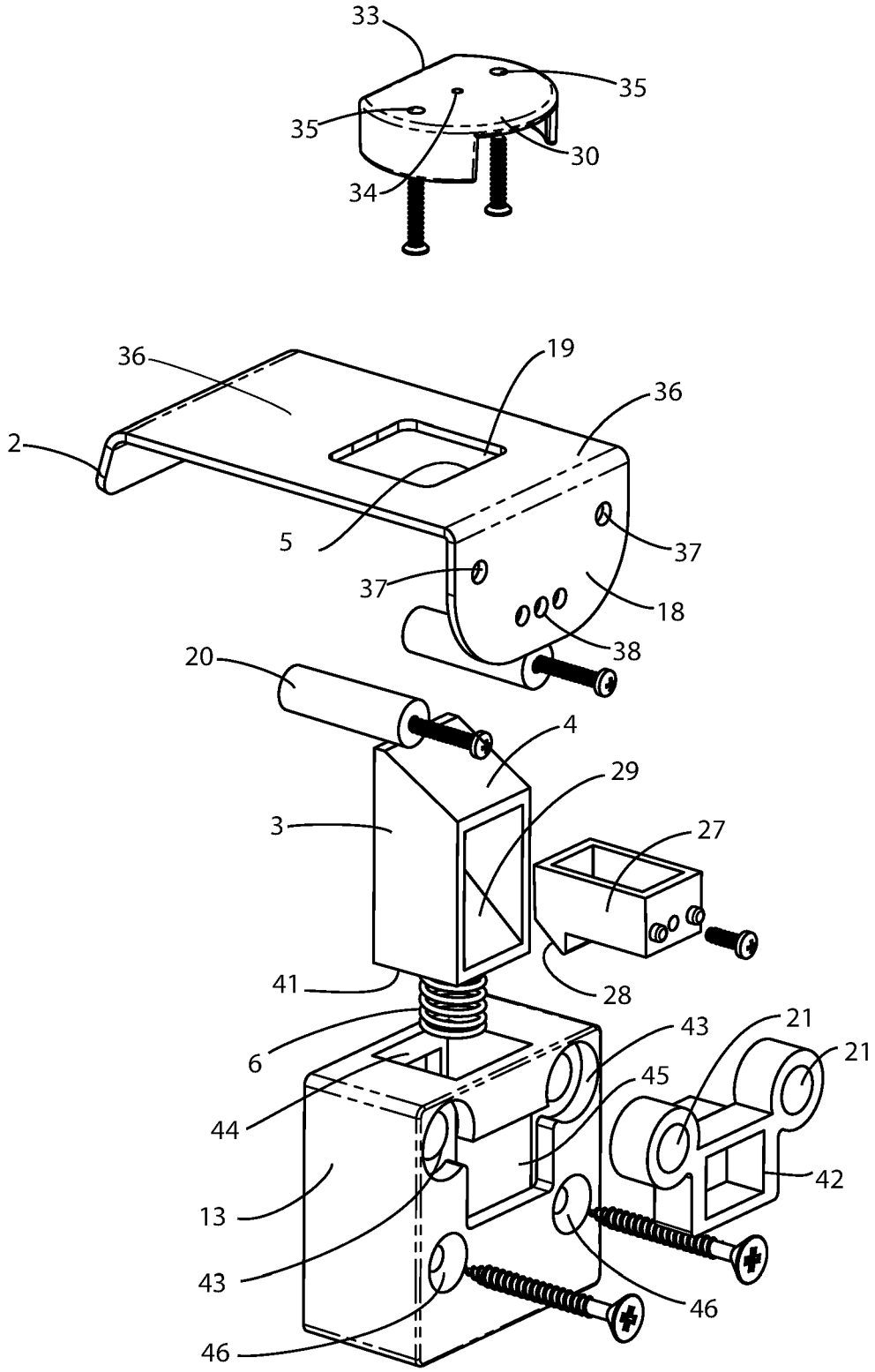
FIG. 10 shows an exploded perspective view of the various components of the latching mechanism of FIG. 6.

Illustrated below striker plate 30 in FIG. 10 is the rounded-rectangular-shaped handle plate 36, which includes handle 2 at one end and vertical projection 18 at the other end. Vertical projection 18 has screw holes 37 through which screws can fix guide elements 20. Vertical projection 18 also has fixing holes 38 which can be used for attachment to actuator 5. Handle plate 36 can be made from metal, plastic or any other suitable substance.

Illustrated below handle plate 36 in FIG. 10 is latch 3, which includes oblique surfaces 4 and 29. Latch 3 preferably has a flat bottom 41 for easier co-operation with biasing means 6, which is shown as a spring in the example embodiment, but which may be flexible rubber or any other suitable resiliently compressible substance or mechanism. Latch 3 may be made from metal, plastic, wood or any other suitable material.

Illustrated to the right of latch 3 in FIG. 10 is second actuator 27, which includes oblique surface 28. The second actuator is preferably made from moulded plastic or another suitable substance. Cooperating with second actuator 27 is guide component 42 which guides the movement therethrough of second actuator 27 and also includes sleeves 21 which, when the latching mechanism is assembled, are located around guide elements 20. Thus, in operation, when handle 2 is pulled towards the operator, handle plate projection 18 pushes second actuator 27 in the same direction. The effect of actuator oblique surface 28 acting on latch internal oblique surface 29 forces latch 3 in a downwards direction contrary to the biasing effect of biasing means 6. When handle 2 is no longer being pulled by the operator, biasing means 6 pushes latch 3 back up towards its normal location, and the effect of latch internal oblique surface 29 acting on second actuator oblique surface 28 causes second actuator 27 to be retracted to its normal position, in turn causing handle 2 to return to its normal orientation relative to the other elements in the latching mechanism. The relative positioning of the various elements of FIG. 10 when properly assembled can best be seen in the cross-sectional view of FIG. 9.

Illustrated below latch 3 and biasing means 6 in FIG. 10 is chamber 13. Chamber 13 includes guide apertures 43 which co-operate with guide elements 20 to constrain the lateral movement of the latching mechanism and assist stability. Chamber 13 further includes top aperture 44 which is slightly larger than the horizontal cross-sectional dimensions of latch 3, allowing latch 3 to move upwardly and downwardly within top aperture 44.

Chamber 13 further includes side aperture 45 which admits second actuator 27, allowing second actuator 27 to move in and out as the latching mechanism is in use.

In this particular embodiment, chamber 13 further includes screw holes 46, providing means for attachment of the latching mechanism to a drawer, door, or other item which requires a latching mechanism. It will be appreciated that the example embodiment has the advantage that it can be affixed to a typical door or drawer very easily without requiring any modifications other than the attachment of chamber 13 to the rear side of the door or drawer front panel. This is a considerable advantage because it makes installation fast and simple, significantly reducing the cost of labour when compared with many other types of latching mechanisms.

The exemplified embodiment of the invention has a latch which moves up and down, in an orientation suitable for a drawer latch. It will be readily understood that the latching mechanism can be operated in an orientation whereby the latch moves horizontally, as may be suitable for cupboard doors, or in any other required orientation.

It will be seen that movement of the handle to open a drawer or door using the latching mechanism of the present invention is in the identical direction of opening; that is, the operator who wants to open a drawer or door simply pulls the handle towards them. This makes the movement of the handle more intuitive and also less complex than the movements required of handles in other latching arrangements, which involve turning a handle, pushing a button while pulling a handle, or lifting a handle.

The invention claimed is:

1. A latching mechanism for a drawer or door including:

a) a handle which is pulled when the latching mechanism is being opened and pushed when the latching mechanism is being closed;

b) a latch which is moveable between an extended orientation and a retracted orientation;

c) an oblique surface on the latch which is obliquely angled relative to a direction of opening or closing movement of the handle;

d) an actuator which contacts the oblique surface of the latch when the handle is pulled, forcing the latch towards the retracted orientation;

e) biasing means which biases the latch towards the extended orientation; and f) a link which connects the handle to remaining parts of the latching mechanism;

wherein:

the handle, link and actuator are integrally formed from a single sheet of metal or plastic;

the single sheet of metal or plastic is substantially in the shape of a rectangle, having a front end and a rear end;

the handle is formed by bending the front end of the rectangle relative to a plane of the rectangle; and the rectangle includes an internal aperture, one edge of which functions as the actuator.

2. A latching mechanism according to claim 1 wherein:

the rear end of the rectangle is also bent relative to the plane of the rectangle; and wherein the rear end of the rectangle attaches slidably to a chamber which substantially houses the latch and the biasing means.

3. A latching mechanism according to claim 1 further including a second actuator which has an oblique surface oriented at an angle matching that of an internal oblique surface on the latch, so that the oblique surface of the second actuator slides across the internal oblique surface on the latch as the handle is pulled, forcing the latch towards the retracted orientation, and when the handle is no longer being pulled, the biasing means urges the latch towards the extended orientation, causing the oblique surface of the second actuator to slide back across the internal oblique surface on the latch and restoring the latch to the extended orientation.

4. A latching mechanism according to claim 1 further including one or more guide elements which help to guide and constrain movement of the handle relative to a remainder of the latching mechanism.

5. A latching mechanism according to claim 1 further including a striker plate which co-operates with the latch to retain the latching mechanism in a closed orientation until the handle is pulled.

6. A latching mechanism according to claim 5 wherein the striker plate is substantially in the shape of a circle with a flattened side, and wherein the flattened side forms a striker which co-operates with the latch.

* * * * *